United States Patent [19]

Hirayama

[11] 4,167,913

[45] Sep. 18, 1979

[54] TRANSMISSION MECHANISM IN A DRIVING MEANS FOR NEEDLE OF SEWING MACHINES

[75] Inventor: Tetsuro Hirayama, Chofu, Japan

[73] Assignee: Juki Co., Ltd., Tokyo, Japan

[21] Appl. No.: 865,897

[22] Filed: Dec, 30, 1977

[51] Int. Cl.[2] ..... D05B 55/14

[52] U.S. Cl. ..... 112/221; 74/104

[58] Field of Search ..... 112/221, 270; 74/103, 74/104

[56] References Cited

U.S. PATENT DOCUMENTS

| | | | |
|---|---|---|---|
| 2,799,236 | 7/1957 | Marforio et al. | 112/221 |
| 3,645,221 | 2/1972 | Hirayama | 112/221 |
| 3,731,643 | 5/1973 | Middlebrook | 112/221 |
| 3,745,951 | 7/1973 | Marforio | 112/221 |
| 4,037,548 | 7/1977 | Hirayama | 112/221 X |

*Primary Examiner*—H. Hampton Hunter

*Attorney, Agent, or Firm*—Basile and Weintraub

[57] ABSTRACT

A transmission mechanism in a driving means for the needle of sewing machines. A needle holder having a needle secured thereto and fitted on a needle guide rod so that it is vertically oscillated thereon is joined to an oscillatory arm oscillatable along the needle guide rod by slidably fitting a front end portion of the latter in a passage provided in an end portion of a horizontal shaft which is fitted in the needle holder so as to be rotated therein to some extent. The passage in the end portion of the horizontal shaft is made at right angles thereto. The horizntal shaft has a vertical passage the diameter of which is large enough to prevent the needle guide rod passed therethrough from being slided on the inner surface thereof. The needle holder has a sufficiently large slide surface with respect to the needle guide rod.

1 Claim, 3 Drawing Figures

TRANSMISSION MECHANISM IN A DRIVING MEANS FOR NEEDLE OF SEWING MACHINES

BACKGROUND OF THE INVENTION

1. Field of the Invention

The present invention relates to a transmission mechanism in a driving means for the needle of sewing machines and, more particularly, to a system for joining which is guided by a needle guide rod, to an oscillatory arm of a mechanism for causing exactly linear movements via a horizontal shaft fitted in the needle holder. The present invention provides a transmission mechanism in which the horizontal shaft is fitted in a passage in the needle holder, which horizontal shaft is provided with a vertical passage of a diameter large enough to prevent the needle guide rod passed therethrough from being slided on the inner surface thereof so that the area of slide surface of the needle holder with respect to the needle guide rod is kept uniform.

2. Description of Prior Arts

In general, the transmission mechanisms in a needle driving means of this kind are classified into a mechanism for causing nearly linear movements by which a portion where the needle holder and the oscillatory arm are joined together is moved along an arcuate line which is almost straight, and a mechanism for causing exactly linear movements by which the needle holder is moved along an exactly straight line.

A mechanism for causing nearly linear movements is designed on the basis of strict calculations of the linking ratio and errors in the linear movements of a portion where the needle holder and the oscillatory arm are directly connected to each other are proportional to the accuracy of the parts constituting the links. Therefore, the accuracy of each part requires to be absolutely perfect and the cost of manufacturing the mechanism necessarily becomes high. On the other hand, among the mechanisms for causing exactly linear movements, there is one in which the needle holder fitted on the needle guide rod is connected to the front end of a slidable shaft coaxially and slidably fitted in the oscillatory arm so that the needle guide rod is positioned on the extension line of the axis of the slidable shaft (as shown in, for example, Japanese Patent Publication No. 5422/1971).

According to the above publication, the portion where the needle guide rod, slidable shaft and needle holder are joined together and the axis of the oscillatory arm are on the same straight line and the above-mentioned joining portion is between the needle guide rod and the oscillatory arm. Consequently, when the needle holder is upwardly moved, a bending moment is exerted on the axis line of the needle guide rod and the frictional resestance due to the sliding of the needle holder on the guide rod increases. Then, there is the possibility that seizure occurs due to the heat generated during a high-speed operation of the sewing machine. The increase in frictional resistance causes wear of the parts and the durability of the machine lowers. In addition, errors occur in the positions at which the vertical movements of the needle are started and stopped and, in hemstitch sewing machines, the intersection of the needle and looper is sometimes in an improper position. Among the mechanisms for causing exactly linear movements, there is another one which includes a needle holder having longitudinal, transverse and vertical passages, a horizontal shaft having longitudinal and vertical crucial passages and fitted in the transverse passage of the needle holder, an oscillatory arm having at the front end portion thereof a vertical passage and fitted in the longitudinal passage of the horizontal passage, and a needle guide rod passed through the vertical passages in the needle holder, horizontal shaft and oscillatory arm, to vertically move the needle holder by the movement of the oscillatory arm (as shown in, for example, Japanese Patent Publication No. 5946/1974). However, the above mechanism is of a complicated construction and cannot be manufactured at a low cost. Moreover, the oscillatory arm has to be made thick so as to be sufficiently strong since it has a vertical passage through which the needle guide rod is passed. The horizontal shaft is formed outside the oscillatory arm and the needle holder is formed outside the horizontal shaft. Consequently, the mechanism as a whole is forced to be a large-sized one, which has an increased weight and an increased inertia of movement. As a result, it is not suitable for a high-speed operation of sewing machines. Among the mechanisms for causing exactly linear movements, there is still another one which includes a needle holder provided at the left and right sides thereof with a projection, and an oscillatory arm having in the front end portion thereof an elongated passage with which the projections of the needle holder are engaged in the form of a pin joint (as shown in, for example, Japanese Patent Publication No. 5946/1974). In the above mechanism, the area of the surface of the needle holder in contact with the surface of the needle guide rod is not sufficiently large. Moreover, since the needle holder slidingly contacts the needle guide rod, the contact portions thereof are greatly worn and then, the mechanism has a poor durability.

SUMMARY OF THE INVENTION

It is therefore an object of the invention to provide a transmission mechanism suitable for a high-speed operation of sewing machines by miniaturizing the needle holder and the neighbouring members to reduce the weight and inertia of movement thereof. It is another object of the invention to provide a transmission mechanism in which the area of the contact surfaces of the needle guide rod and needle holder is uniform to greatly increase the wear resistance thereof and to cause no variation in the locus of the vertically moving needle.

This invention relates to an improvement in a transmission mechanism in a needle driving means in sewing machines, which comprises what is called a mechanism for causing exactly linear movements and, more particularly, to a needle driving means for sewing machines, which comprises a vertical guide rod projected from a machine frame, a needle holder having a needle secured thereto and slidably fitted on the needle guide rod, and an oscillatory arm pivotally connected to a shaft and oscillatable therearound by the rotation of a main rotary shaft, the front end of the oscillatory arm being connected to the needle holder so as to vertically and linearly move it. More particularly, this invention relates to a needle driving means having a needle secured to a needle holder as it is downwardly directed, a needle guide rod, an outer frame unitarily formed with the needle holder and provided with a cross-sectionally circular passage therein, a horizontal shaft fitted in the passage in the needle holder so that it is rotatable in the direction of the circumference of the passage and provided with a vertical passage therein the diameter of which is large enough to prevent the vertically moving needle guide rod from coming into contact therewith as well as a horizontal passage at the end portion thereof which is at right angles to the passage in the outer frame of the needle holder, and an oscillatory arm the front end portion of which is slidably and axially fitted in the horizontal passage in the horizontal shaft.

The needle driving means of the above construction has the following effect. The members by which the needle holder is formed do not have a complicated construction and then, they can be miniaturized. The horizontal shaft and the oscillatory arm are joined together only by slidably fitting the front end portion of the latter in the horizontal passage in the former and, consequently, the oscillatory arm can be made thin. This allows the weights of the needle holder and its neighbouring members to be reduced. Then, the inertia of movement of the needle holder is reduced to a great extent, and a transmission mechanism suitable for a high-speed operation of sewing machines can be obtained. Owing to the above-described construction of the present invention, the bending moment produced by the oscillation of the oscillatory arm is not concentrated upon one point. Moreover, the transmitting of movements in this invention is entirely effected by the contact surfaces of the parts and thus, the frictional resistance is not concentrated upon one point. Therefore, the means of this invention is not partially damaged and worn, and the locus of the vertical movements of the needle are hardly out of order. According to the present invention, a strongly-built transmission mechanism can really be obtained. In addition, the means of the present invention is made of a reduced number of parts and it can be easily assembled.

Other objects, features and advantages of the invention will be apparent from the following description taken in connection with the accompanying drawings.

DETAILED DESCRIPTION OF THE PREFERRED EMBODIMENT

Figure 1:
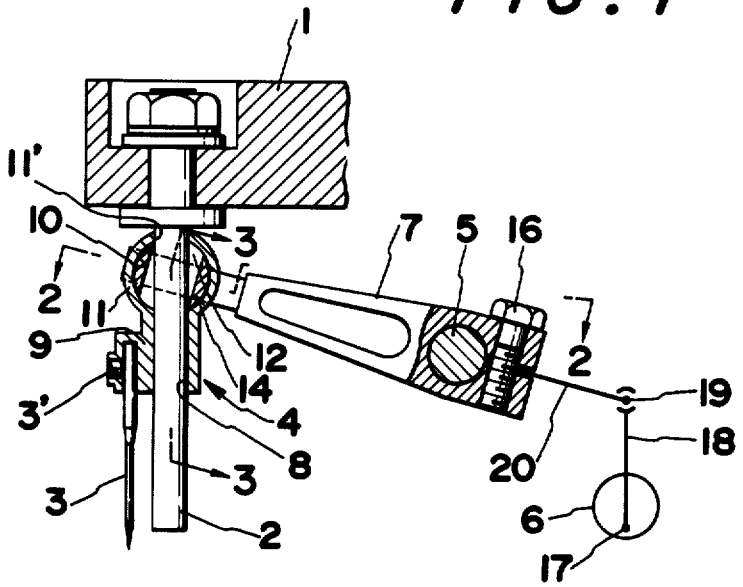
FIG. 1 is a schematic front elevational view partially in section of the needle driving means of the present invention.
Figure 2:
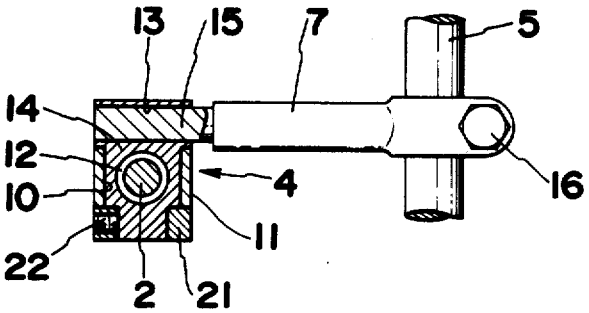
FIG. 2 is a plan view partially in section taken along the line 2—2 in FIG. 1.
Figure 3:
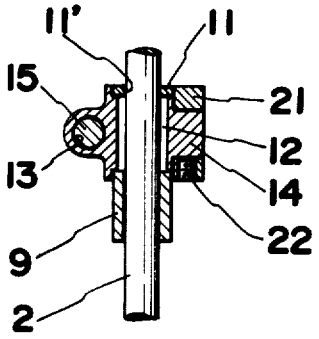
FIG. 3 is a cross-sectional view taken along the line 3—3 in FIG. 1.

The most preferred embodiment of the present invention is based on a driving means for needle of sewing machines, which is of a mechanism for causing exactly linear movements and which comprises a machine frame 1; a guide rod 2 vertically projected from the machine frame 1; a needle holder 4 slidably fitted on the guide rod 2 and having a needle 3 secured thereto; and an oscillatory arm 7 pivotally connected to a shaft 5 and oscillatable around the shaft 5 by the rotation of a rotary main shaft 6, an end of the oscillatory arm 7 being connected to the needle holder 4 to linearly move it up and down.

The embodiment having the above-described basic construction includes a needle holder main body 9 having a downwardly directed needle 3 secured thereto as well as a vertical passage 8 therein in which a guide rod 2 is slidably fitted; an outer frame 11 unitarily formed on the main body 9 and having therein a horizontal and cross-sectionally circular passage 10; a horizontal shaft 14 fitted in the horizontal passage 10 in the outer frame 11 so that it is rotatable in the direction of the circumference of the horizontal passage 10, provided therein with a passage 12 the diameter of which is large enough to prevent the guide rod 2 during the vertical movement thereof from coming in contact with the inner surface thereof, and provided therein with a passage 13 made at right angles to the horizontal passage 10; and an oscillatory arm 7 an end portion 15 of which is fitted in the passage 13 in the horizontal shaft 14 so that the arm 7 can be axially and slidingly moved therein.

The machine frame 1 constituting a part of a sewing machine main body is provided with a cylindrical, downwardly directed guide rod 2 projected from the lower surface thereof, and, on the guide rod 2, the needle holder 4 is fitted, which has a sliding surface of a sufficient area. The needle holder 4 has in a front portion of its main body 9 a downwardly directed needle 3 secured thereto with a bolt 3' and allows the guide rod 2 to be passed through the vertical passage 8 provided substantially in the central portion of the needle holder main body 9 so that the needle holder 4 can be slidingly moved on the guide rod 2 in the direction of the axis thereof. In the embodiment, the needle 3 is secured to the needle holder 4 at the left side of the guide rod 2 as shown in FIG. 1 but the position at which the needle 3 is secured to the needle holder 4 is not limited to the one as shown in FIG. 1. Namely, the needle 3 may be secured to such a portion of the needle holder 4 that is before or behind the the guide rod 2 as shown in FIG. 1. On the needle holder main body 9, the outer frame 11 is provided, which has therein the cross-sectionally circular, horizontal passage 10 and which has at the top portion thereof a hole 11' or an extended portion of the vertical passage 8, through which the guide rod 2 is passed. In the horizontal passage 10, the horizontal shaft 14 is fitted so that it is slidingly moved on the inner surface thereof in the direction of the circumference thereof. The horizontal shaft 14 is provided with a circular, vertical passage 12 the diameter of which is greater than that of the guide rod 2. The diameter of the passage 12 has only to be so great as to prevent the guide rod from coming into contact with the horizontal shaft 14 even when the horizontal shaft 14 is rotated in the direction of the circumference of the horizontal passage 10 by the oscillation of the oscillatory arm 7. The horizontal shaft 14 is provided at one side of the passage 12 with a horizontal passage 13 which is at right angles to the horizontal passage 10. In the passage 13, the front end portion 15 of the oscillatory arm 7, which is oscillatable around the shaft 5 by the rotation of the rotary main shaft 6, is fitted so as to be slidingly moved in the direction of the axis thereof. The oscillatory arm 7 is fastened to the rotary shaft 5 with a bolt 16, and the shaft 5 is connected to a ball crank 17 of the main shaft 6 via a rod 18, a ball joint 19 and an arm 20. The horizontal shaft 14 is provided thereon a collar 21 which is fastened thereto with a bolt 22 and which is in contact with the end surface of the outer frame 11 to firmly fit the horizontal shaft 14 in the horizontal passage 10 in the outer frame 11.

When the rotary shaft 6 is rotated to vertically oscillate the oscillatory arm 7, the needle holder 4 is vertically moved accordingly while guided by the guide rod 2. Since the oscillatory arm 7 is rotated around the shaft 5, the end portion 15 thereof is vertically moved so as to draw an arc but the needle holder 4 is smoothly moved up and down because the front end portion 15 is slidingly moved in the passage 13 in the direction of the axis thereof. At this time, the horizontal shaft 14 is rotated in the horizontal passage 10 in the needle holder 4 in the direction of the circumference thereof and the changes in angle of rotation of the oscillatory arm 7 are represented by those in angle of rotation of the horizontal shaft 14. Thus, the needle holder 4 is linearly moved up and down together with the needle 3.

Since the construction of each of the members which constitute the needle holder of the means of the present invention is not complicated, each member can be miniaturized. Furthermore, the combining of the horizontal shaft with the oscillatory arm is effected by only slidably fitting the end portion of the latter in the passage provided in the former and then, the oscillatory arm can be made thin. This allows the weights of the needle holder and the neighbouring members to be reduced. Therefore, the inertia of movement of the needle holder can also be reduced to a great extent. Thus, a transmission mechanism suitable for high-speed operations can be obtained. Since the present invention has the above-mentioned construction, the bending moment produced by the oscillation of the oscillatory arm is not concentrated on one point. Moreover, the surface of the movement-transmitting portion of the present invention are entirely in contact with that of the portion to which the movement is to be transmitted and then, the frictional resistance is not concentrated on one point. Therefore, in the transmission mechanism according to the present invention, there is no possibility that it is locally damaged or worn and the locus of the vertically moving needle is hardly varied. In fact, a strongly-built transmission mechanism can be obtained in the present invention. Since it consists of a small number of parts and since it has a simple construction, it can be assembled easily at a low cost.

While the described embodiment represents the preferred form of the present invention, it is to be understood that modifications will occur to those skilled in the art without departing from the spirit of the invention. The scope of the invention is therefore to be determined solely by the following claim.

I claim:

1. A driving means for a needle of sewing machines, which is of a mechanism for causing exactly linear movements comprising a vertical guide rod projected from a machine frame, a needle holder having a downwardly directed needle secured thereto and a vertical passage in the central portion thereof to be slidably fitted on said guide rod, an oscillatory arm connected at a front end thereof to said needle holder and pivotally supported on a shaft so as to be oscillated therearound by the rotation of a rotary main shaft, and a horizontal shaft fitted in a horizontal passage provided in said needle holder and joined to said oscillatory arm so that they are at right angles to each other, said driving means being characterized by an outer frame unitarily formed on a needle holder mainbody of said needle holder and having a cross-sectionally circular, horizontal passage therein, a vertical passage made in said horizontal shaft rotatably fitted in said outer frame, which vertical passage is of a diameter large enough to substantially prevent said guide rod passed therethrough from being slid on the inner surface thereof, and a horizontal passage made in an end of said horizontal shaft, which is outside said outer frame, so that it is at right angles to the axis of said horizontal shaft, which horizontal passage receives therein a front end portion slidable therein of said oscillatory arm.

* * * * *